US008484868B2

(12) United States Patent
Kim et al.

(10) Patent No.: US 8,484,868 B2
(45) Date of Patent: Jul. 16, 2013

(54) LAUNDRY TREATING APPARATUS

(75) Inventors: Jong Seok Kim, Seoul (KR); Sung Min Kim, Seoul (KR); Dae Yun Park, Seoul (KR); Sog Kie Hong, Seoul (KR)

(73) Assignee: LG Electronics Inc., Seoul (KR)

( * ) Notice: Subject to any disclaimer, the term of this patent is extended or adjusted under 35 U.S.C. 154(b) by 259 days.

(21) Appl. No.: 13/039,747

(22) Filed: Mar. 3, 2011

(65) Prior Publication Data

US 2011/0225857 A1 Sep. 22, 2011

(30) Foreign Application Priority Data

Mar. 3, 2010 (KR) ..... 10-2010-0018936

(51) Int. Cl.
*D06F 58/10* (2006.01)
*A47H 99/00* (2009.01)

(52) U.S. Cl.
USPC ..... 38/14; 211/124

(58) Field of Classification Search
USPC ..... 38/3, 1 A; 68/5 C, 5 R; 248/317; 211/7, 211/123, 124
See application file for complete search history.

(56) References Cited

U.S. PATENT DOCUMENTS

| | | | | |
|---|---|---|---|---|
| 3,567,034 | A * | 3/1971 | Mozelsio | 211/7 |
| 3,739,496 | A * | 6/1973 | Buckley et al. | 34/210 |
| 5,018,627 | A | 5/1991 | Moore | |
| 5,755,040 | A * | 5/1998 | Ou | 34/202 |
| 7,103,996 | B2 * | 9/2006 | Hapke | 38/14 |
| 7,137,211 | B2 * | 11/2006 | Johnson et al. | 34/381 |
| 7,235,109 | B2 * | 6/2007 | Kleker | 8/149.3 |
| 7,587,917 | B2 * | 9/2009 | Gilboe et al. | 68/240 |
| 8,151,495 | B2 * | 4/2012 | Kim et al. | 38/14 |
| 2002/0148797 | A1 * | 10/2002 | Feder | 211/124 |
| 2005/0035076 | A1 | 2/2005 | Schober et al. | |

FOREIGN PATENT DOCUMENTS

| | | |
|---|---|---|
| JP | 2004-033300 | 2/2004 |
| JP | 2009-189408 | 8/2009 |

* cited by examiner

*Primary Examiner* — Ismael Izaguirre
(74) *Attorney, Agent, or Firm* — McKenna Long & Aldridge LLP

(57) ABSTRACT

The present invention relates to a laundry treating apparatus which can make easy drying, deodorizing, crumple removal and sterilization of clothes, characterized in that laundry treating apparatus is provided with a hanger bar for receiving clothes hangers of different shapes.

12 Claims, 4 Drawing Sheets

LAUNDRY TREATING APPARATUS

Pursuant to 35 U.S.C. §119(a), application claims priority to Korean Patent Application No. 10-2010-0018936, filed on Mar. 3, 2010, which is hereby incorporated by reference in its entirety as if fully set forth herein.

BACKGROUND OF THE INVENTION

1. Field of the Invention

The present invention relates to a laundry treating apparatus which can make drying, deodorizing, crumple removal and sterilization of clothes.

2. Discussion of the Related Art

In general, the laundry treating apparatus is an apparatus for handling various operations related to clothes and has a concept to include a washing machine for washing clothes, a dryer for drying wet clothes, and a refresher for removal of odor or crumples from the clothes.

In the meantime, it is a trend that the laundry treating apparatus is developed to handle clothes washing, drying, deodorizing, and crumple removal with one apparatus. However, the laundry treating apparatus, using a drum for holding the clothes, and a driving unit for rotating the drum, is inadequate for deodorizing and crumple removal from the clothes.

That is, in general, since a related art laundry treating apparatus processes deodorizing and crumple removal from the clothes during the drum is rotating in a state the clothes in the drum is, not spread, but crumpled, the deodorizing and crumple removal from the clothes with the laundry treating apparatus has a limitation.

SUMMARY OF THE INVENTION

To solve the problems, an object of the present invention is to provide a laundry treating apparatus which can make easy drying, deodorizing, crumple removal and sterilization of clothes.

Another object of the present invention is to provide a laundry treating apparatus which can house different types of clothes hangers.

To achieve these objects and other advantages and in accordance with the purpose of the invention, as embodied and broadly described herein, a laundry treating apparatus includes a clothes housing portion for housing clothes therein, a supply unit for supplying air or water to the clothes housing portion, a clothes hanger provided to hang the clothes and to have a hook for placing the clothes hung therefrom in the clothes housing portion or taking the clothes hung therefrom away from the clothes housing portion, a hanger bar positioned in the clothes housing portion, the hanger bar having clothes hanger slots each for receiving the hook, a driving unit for making the hanger bar to move in the clothes housing portion, and a hook holding portion provided to each of the clothes hanger slots for elastic holding of the hook of the clothes hanger.

In this case, the hook holding portion can be provided as one pair at opposite ends of the clothes hanger slot, respectively.

And, the one pair of the hook holding portions can include fixed portions fixed to opposite ends of the clothes hanger slot respectively, and extensions extended from the fixed portions, respectively.

The extension formed each of the one pair of the hook holding portions can have an elastic force applied thereto in directions opposite to each other.

And, the extension formed each of the one pair of the hook holding portions can be in contact with each other.

And, the hook holding portion can include a holding portion provided in the clothes hanger slot so as to be in contact with the hook, and an elastic member for making elastic supporting of the holding portion to enable the holding portion to move within the clothes hanger slot.

And, the holding portion can be provided to opposite ends of the clothes hanger slot for holding opposite sides of the hook.

And, the holding portion can have a sloped top side.

In the meantime, the hook holding portion is a holding rubber piece, wherein the holding rubber piece can include a holding surface provided in the clothes hanger slot so as to be in contact with the hook, and a coupling surface which is an extension from the holding surface fixed to the clothes hanger slot.

In this case, the holding rubber piece can be provided to the opposite ends of the clothes hanger slot.

And, the holding surface can have a sloped top side.

In the meantime, the hook holding portion can include a holding rib which is an extension from one end of the clothes hanger slot so as to be in contact with the hook.

In this case, the holding rib can be formed of rubber.

And, the hook holding portion can include a moving away preventive rib having a length greater than a length of the holding rib for preventing the hook from moving away from the clothes hanger slot.

And, a laundry treating apparatus includes a clothes housing portion for housing clothes therein, a supply unit for supplying air or moisture to the clothes housing portion, a clothes hanger provided to hang the clothes and to have a hook for placing the clothes hung therefrom in the clothes housing portion or taking the clothes hung therefrom away from the clothes housing portion, a hanger bar positioned in the clothes housing portion, the hanger bar having clothes hanger slots each for receiving the hook, a driving unit for making the hanger bar to move in the clothes housing portion and a hook holding portion provided to each of the clothes hanger slots for providing a space for receiving the hook according to a diameter of the hook.

BRIEF DESCRIPTION OF THE DRAWINGS

The accompanying drawings, which are included to provide further understanding of the disclosure and are incorporated in and constitute a part of this application, illustrate embodiments of the disclosure and together with the description serve to explain the principle of the disclosure.

In the drawings.

DETAILED DESCRIPTION OF THE INVENTION

Reference will now be made in detail to the specific embodiments of the present invention, examples of which are illustrated in the accompanying drawings. Wherever possible, the same reference numbers will be used throughout the drawings to refer to the same or like parts.

As far as there is no particular definition, all terms in the specification are the same with a general meaning of the term understood by persons skilled in this field of art, and, if the term used in the specification conflicts with the general meaning of the term, the meaning of the term used in the specification prevails.

In the meantime, a configuration or a control method of a device described hereinafter is provided only for describing embodiments of the present invention, but not for limiting scope of patent rights of the present invention.

The specification will describe a laundry treating apparatus taking a refresher for drying and refreshing clothes as an example.

In this instance, the refresh means a clothes treating process in which air, heated air, water, mist, or steam is provided toward the clothes for removal of crumples, deodorizing, sterilization, and preventing static electricity.

The clothes in this specification includes, not only clothes, and apparel, but also objects people uses, such as a doll, a handkerchief, and blanket, along with objects a person can wear, such as shoes, socks, gloves, a headgear, a muffler, i.e., all objects requiring washing.

Figure 1:
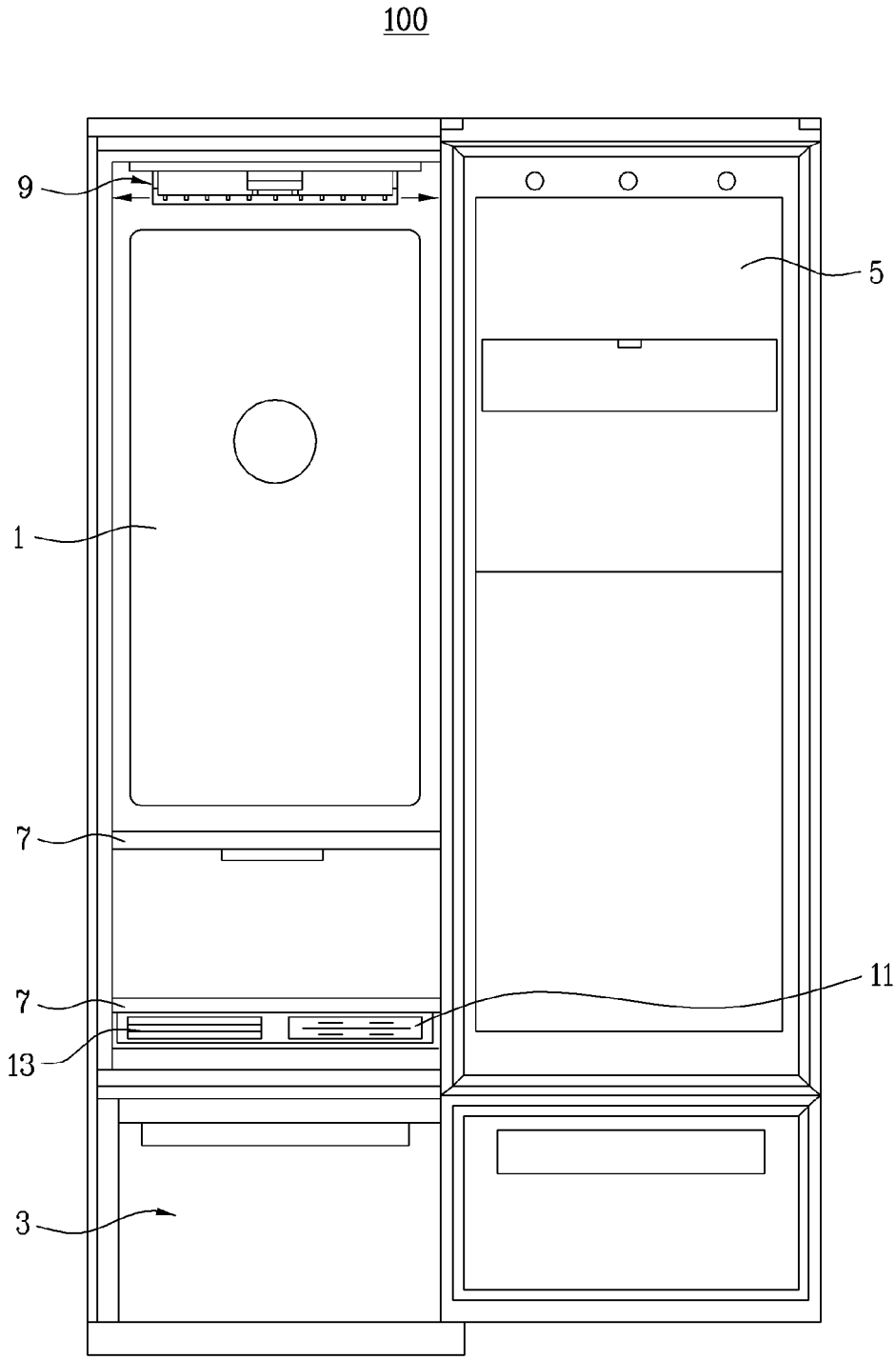
FIG. 1 illustrates a front view of a laundry treating apparatus in accordance with a preferred embodiment of the present invention.

FIG. 1 illustrates a front view of a laundry treating apparatus in accordance with a preferred embodiment of the present invention.

Referring to FIG. 1, the laundry treating apparatus 100 can include a clothes housing portion 1 for housing the clothes therein, and a supply unit portion 3 having a supplying unit provided thereto for supplying air (heated and unheated air, collectively), or water (water, steam, and mist, collectively) to the clothes housing portion. Moreover, the laundry treating apparatus can include a door 5 provided for opening/closing the clothes housing portion 1, additionally.

The supply unit portion 3 provides a space for providing an air supply unit (not shown) thereto for supplying air or hot air to the clothes housing portion and/or a water supply unit (not shown) thereto for supplying water, mist or steam to the clothes housing portion.

In this case, the air supply unit can be provided to supply the air or hot air to the clothes housing portion 1 through an air inlet 13 in the clothes housing portion 1, and the water supply unit can be provided to supply the mist or steam to the clothes housing portion through a water inlet 11 in the clothes housing portion.

In the meantime, if the air supply unit is provided to supply the hot air, the air supply unit can be provided as an air discharge type in which the air supply unit heats and supplies external air to the clothes housing portion 1, or a circulating type in which the air supply unit circulates air within the clothes housing portion while dehumidifying and heat exchanging in a circulating process.

In a case of the air discharge type, the clothes housing portion 1 has a duct (not shown) provided additionally for making an inside of the clothes housing portion and an outside of the laundry treating apparatus in communication, and the air supply unit will have the heater (not shown) provided to a duct (not shown) which is in communication with the outside of the laundry treating apparatus for heat exchange.

In a case of the circulating type, the air supply unit is required to be provided with a duct (not shown) for drawing in air from an inside of a clothes housing space through a suction portion (not shown) in the clothes housing portion 1 and re-supplying the air to the clothes housing portion 1 through the air inlet 13, and a heat exchanger provided in the duct for dehumidifying and heating (heat exchange) the air.

In the circulating type air supply unit, the heat exchanger can be a heat pump (not shown) for dehumidifying and heating the air introduced to the circulating duct with an evaporator (not shown) for circulating refrigerant, a compressor (not shown) for compression of the refrigerant, a condenser (not shown) for condensing the refrigerant, and an expansion valve (not shown) for expansion of the refrigerant.

That is, since the evaporator is required to absorb latent heat from air surrounding the evaporator for making the refrigerant to evaporate, the air surrounding the evaporator is cooled down, and moisture is removed from the air in a form of condensed water at the time of cooling down of the air.

And, since the condenser discharges latent heat to surrounding air if the refrigerant is condensed in the condenser, if the air dehumidified at the evaporator passes through the condenser, the air in the circulating duct is heated and supplied to the clothes housing portion 1.

Thus, even though the air heated by the heat pump has a temperature more or less lower than the air heated by a heater, the air can be dehumidified without using an additional dehumidifier.

Accordingly, the air re-supplied to the housing space by the heat pump is relatively 'low temperature dry air' (In this instance, the 'low temperature' does not mean an absolutely low temperature, but a relatively low temperature compared to heated air in the related art, though the air is heated air).

If refreshing or drying of the clothes is performed by using the low temperature dry air, deformation or damage to the clothes caused by a high temperature can be prevented, and since dehumidified air can be supplied without an additional dehumidifier, easy drying and refreshing of the clothes is possible.

In the meantime, a steam generator can be an example of the water supply unit for heating water to supply steam, and, in this case, it is preferable that the steam generator (not shown) is provided with storage means for storing water and a heater (not shown) for heating the stored water.

However, in a case treatment of the clothes with high temperature steam is not required (in a case only mist is supplied), the mist may be supplied to the clothes housing portion by using ultrasonic vibration means (not shown).

The clothes housing portion 1 can include a shelf 7 therein for placing the clothes thereon, additionally. The shelf 7 allows the clothes refreshed by hot air or steam supplied from the air supply unit or the water supply unit in a state the clothes is stationary.

In this case, it is preferable that the shelf 7 has a frame shape with opened top and bottom for enabling the hot air or steam introduced through the water inlet 11 or the air inlet 13 to pass through the shelf.

This is for easy supply of the hot air or steam to the clothes placed on the shelf.

Eventually, since the clothes introduced to the laundry treating apparatus of the present invention is not in an entangled state like the clothes introduced to the related art drum type laundry treating apparatus, excellent effects can be expected, not only in deodorizing and crumple removal, but also in drying the clothes.

Moreover, the laundry treating apparatus 100 of the present invention can include a moving hanger 9 for shaking the clothes in left/right directions or front/rear directions when the drawing is seen from above at the time the hot air or steam is supplied to the clothes housing portion 1, additionally.

Since the moving hanger 9 does not cause the clothes to entangle even if the moving hanger 9 shakes the clothes during the hot air or steam is supplied to the clothes housing portion 1, the moving hanger 9 has effects of improving drying, deodorizing, crumple removal, sterilization efficiency.

Figure 2A:
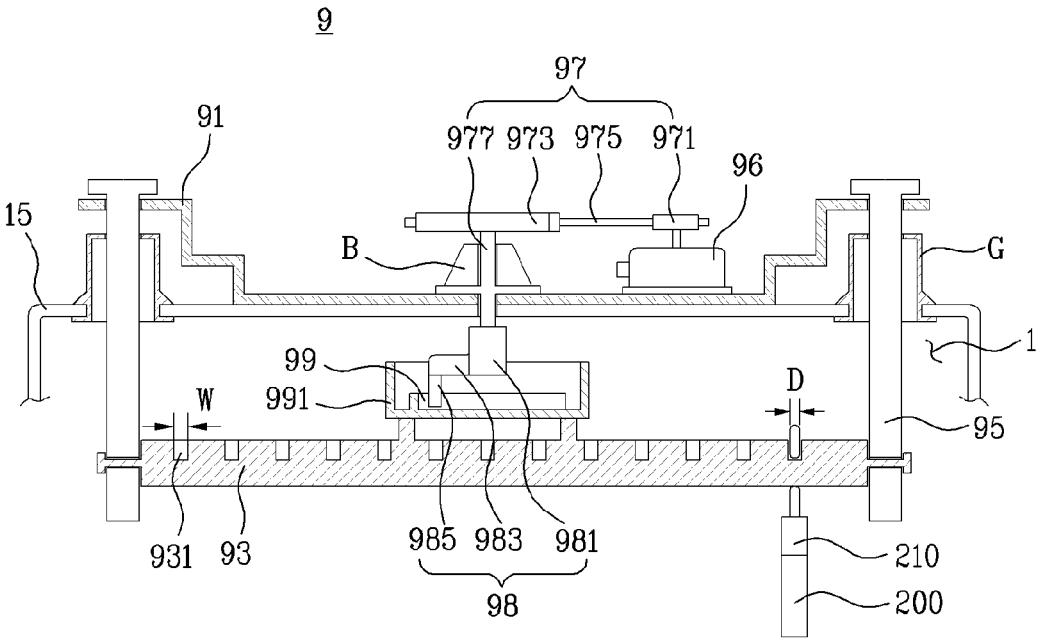
FIGS. 2A~2B illustrate schematic views of a moving hanger provided to a laundry treating apparatus.
Figure 2B:
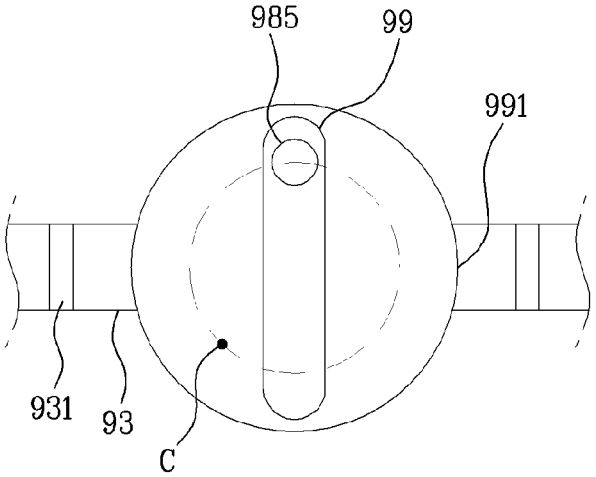

FIGS. 2A and 2B illustrate schematic views of a moving hanger provided to a laundry treating apparatus. The moving hanger 9 will be described with reference to FIGS. 2A and 2B.

The moving hanger 9 includes a frame 91 provided to an upper side outside surface 15 of the clothes housing portion 1, a hanger bar 93 in the clothes housing portion 1 for hanging a clothes hanger 200 therefrom, and a hanger bar holding portion 95 for holding both ends of the hanger bar 93.

The hanger bar holding portion 95 has one end coupled to the frame 91, and the other end coupled to the hanger bar 93. Moreover, it is preferable that a portion of the hanger bar holding portion 95 coupled to the hanger bar is passed through the upper side outside surface 15 of the clothes housing portion 1 and positioned in the clothes housing portion 1.

In this case, a gasket G can be provided additionally for preventing the hot air or steam from leaking through the upper side of the clothes housing portion through which the hanger bar holding portion is passed.

In the meantime, it is preferable that the frame 91 includes a driving unit additionally for providing power which enables the hanger bar 93 to make translational motion within the clothes housing portion 1, wherein the driving unit includes a motor 96, a power converting unit 98 for converting rotating movement of the motor into a translational motion (a horizontal direction linear movement), and a power transmission unit 97 for transmission of power from the motor 96 to the power converting unit 98.

The power transmission unit 97 can include a driving pulley 971 provided to the motor 96, a driven pulley 973 connected to the driving pulley with a belt 975, and a rotating shaft 977 coupled to a center of the driven pulley.

It is preferable that the power transmission unit 97 includes a slot inserting portion 985 inserted in a slot 99 to be described later, a shaft coupling portion 981 coupled to the rotating shaft 977, and a rotating arm 983 connected between the slot inserting portion and the shaft coupling portion.

The slot 99 is provided to the hanger bar 93 through a slot housing 991, and configured to receive the slot inserting portion 985 of the power converting unit 98 therein.

Though the slot 99 can be provided perpendicular to a length direction of the hanger bar 93, or parallel to the length direction of the hanger bar 93, FIG. 2A or 2B shows that the slot 99 is provided perpendicular to the length direction of the hanger bar 93.

In the meantime, there can be a bearing housing B provided between the shaft coupling portion and the driven pulley for supporting rotation of the rotating shaft additionally, and a converter cover (not shown) for preventing the power converting unit from exposing to an outside for improving sense of beauty, additionally.

In the moving hanger of above configuration, if the motor 96 rotates, the driven pulley 973 is rotated by the belt to rotate the rotating shaft 977 coupled to the driven pulley 973 too, making the slot inserting portion 985 to move along a circular locus of a predetermined diameter.

In this case, since the slot 99 provided to the hanger bar 93 is perpendicular to the length direction of the hanger bar to have a length greater than a diameter C of a rotating locus of the slot inserting portion 985, the slot 99 makes a horizontal direction linear motion (translational motion) even if the slot inserting portion 985 makes circular motion.

According to this, the hanger bar 93 connected to the slot 99 will also make the horizontal direction linear motion (translational motion) in the clothes housing portion 1.

In the meantime, it is preferable that the hanger bar 93 has hanger bar slots 931 each for receiving a hook 210 of the clothes hanger to prevent the clothes hanger from falling off the hanger bar 93 during the translational motion by the driving unit and to transmit the movement of the hanger bar to the clothes hung from then clothes hangers 200.

However, a drying performance and a refreshing performance of the laundry treating apparatus vary with a relation between the diameter D of the hook 210 and a width W of the hanger bar slot 931. The performances will be described with respect to the width W of the hanger bar slot and the diameter D of the hook with reference to FIG. 3.

If the diameter D of the hook 210 has a great difference from the width W of the hanger bar slot, even if the hanger bar 93 makes the horizontal direction movement in the clothes housing portion 1, the movement of the hanger bar can not be transmitted to the clothes hanger, adequately.

Figure 3:
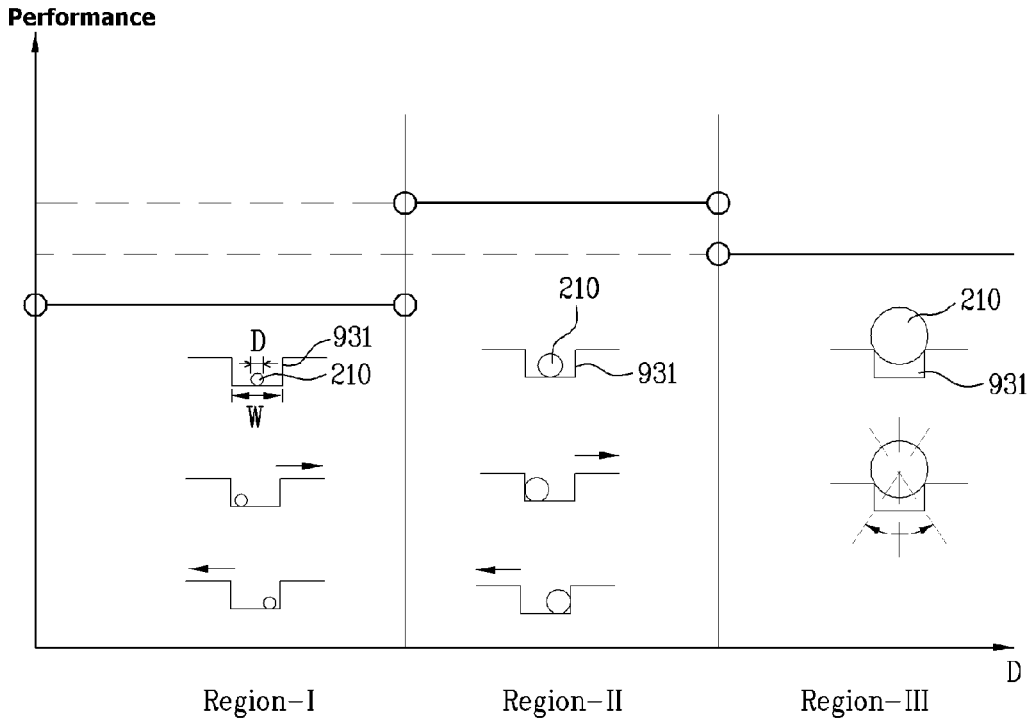
FIG. 3 illustrates a graph for comparing laundry treating apparatuses having different clothes hanger slots and different clothes hanger hook diameters.

That is, as shown in a region-I in FIG. 3, even if the hanger bar 93 moves, the hook 210 will slide on a bottom of the hanger bar slot 931, causing the clothes hung from the hanger bar through the clothes hanger to fail to be shaken in left/right directions, but to maintain almost a stationary state.

Therefore, if the difference of the diameter D of the hook 210 from the width W of the hanger bar slot is great, it is hard to expect an effect of shaking the clothes in the left/right directions in the clothes housing portion despite of the translational motion of the hanger bar.

In the meantime, if the diameter D of the hook 210 is greater than the width W of the hanger bar slot 931, (A region-III in FIG. 3), making the hook 310 to fail to be received in the hanger bar slot 931 causing the hook 210 to move away from the hanger bar slot, it is hard to expect the effect of shaking the clothes in the left/right directions in the clothes housing portion.

However, as shown in a region-II in FIG. 3, if the diameter of the hook 210 is the same with the width of the hanger bar slot 931, or the diameter D of the hook 210 is provided such that the hook 210 can hit either end of the hanger bar slot 931 when the hanger bar 93 moves, not only moving away of the hook from the hanger bar slot can be prevented, and adequate transmission of the movement of the hanger bar 93 to the clothes hanger is possible, but also application of impact to the clothes hung from the clothes hanger is possible at the time the hook 210 hits the hanger bar slot 931, to make the laundry treating apparatus to have an excellent performance compared to the other regions.

Therefore, a structure of the hanger bar which can receive hooks 210 of different diameters to enable the hook 210 of the clothes hanger to make the movement shown in the region-II will be described with reference to FIGS. 4A~4C.

Figure 4A:
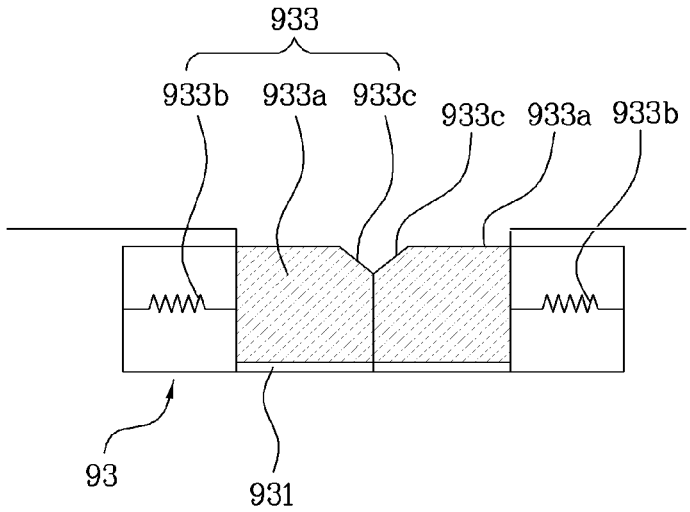
FIGS. 4A~4C illustrate structures of hook holding portions provided to a clothes hanger slot, respectively.
Figure 4B:
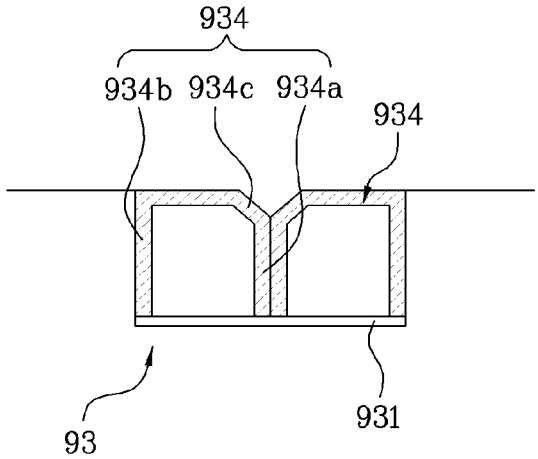
Figure 4C:
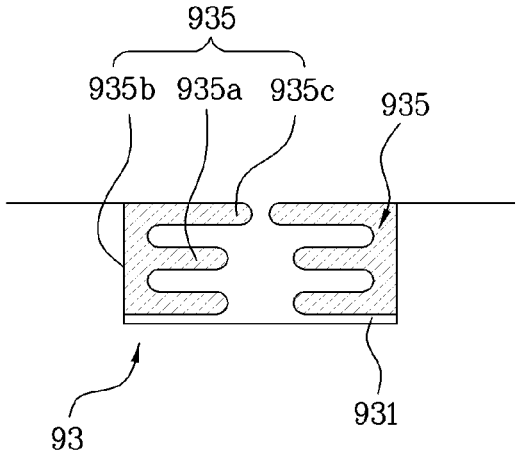

FIGS. 4A~4C illustrate structures of hook holding portions provided to clothes hanger slots respectively, wherein it is preferable that the hanger bar 93 includes clothes hanger slots 931 each for receiving a hook 210 of the clothes hanger 200, and a hook holding portion 933 provided in each of the clothes hanger slots 931 for elastic holding of the hook 210.

A hook holding portion 933 in accordance with a preferred embodiment of the present invention will be described with reference to FIG. 4A. The hook holding portion 933 can include a holding portion 933*a* (the holding portion may include a fixed portion supported by the elastic member and a extension extended from the fixed portion) provided to both ends of the clothes hanger slot, an elastic member 933*b* for making elastic supporting of the holding portion to enable the holding portion to move within the clothes hanger slot 931, and a sloped portion 933*c* provided to a top of the holding portion.

Accordingly, if the user moves the hook 210 to a bottom of the clothes hanger slot through the sloped portion 933*c* for hanging the clothes hanger from the hanger bar, the holding portion moves in left/right directions by the hook when the drawing is seen from above.

Since the holding portion in contact with the hook 210 applies a pressure to an outside surface of the hook owing to the elastic member, the holding portion can prevent the hook 210 from sliding within the clothes hanger slot or moving away from the clothes hanger slot during the translational motion of the hanger bar.

In the meantime, even though the hook holding portion shown in FIG. 4A illustrates a case two holding portions 933*a* are provided, a case is not excluded, in which one holding portion is provided to the clothe hanger slot.

FIG. 4B illustrates a hook holding portion 934 in accordance with another preferred embodiment of the present invention, including a holding rubber piece having a coupling surface 934*b* (or a fixed portion) fixed to one end of the clothes hanger slot, and a holding surface 934*a* (or an extension extened form the fixed portion) which is an extension from the coupling surface 934*b* to be in contact with the hook 210.

In this case, as shown in the drawing, the holding rubber piece can be provided to both ends of the clothes hanger slot to be in contact with each other, and can have a sloped surface 934*c* at a top side of the holding side, additionally.

Accordingly, if the user moves the hook 210 to the bottom surface of the clothes hanger slot through the sloped portion 934*c* for hanging the clothes hanger from the hanger bar, though the holding surfaces 934*a* of the holding rubber pieces move in left/right directions respectively, the moving away from the clothes hanger slot or sliding within the clothes hanger slot of the hook 210 will be prevented owing to elastic force of the holding rubber pieces.

In the meantime, since above effect can be achieved even in a case one holding rubber piece is provided to the clothes hanger slot, different from the drawing, a case in which only one holding rubber piece is provided to the clothes hanger slot is also included to the embodiment.

FIG. 4C illustrates a hook holding portion 935 in accordance with another preferred embodiment of the present invention, including a holding rubber piece having a coupling surface 935*b* (or a fixed portion) fixed to one end of the clothes hanger slot, and a holding rib 935*a* (or an extension) which is an extension from the coupling surface.

In this case, the holding rubber piece can include a moving away preventive rib 935*c* having a length greater than a length of the holding rib for preventing the hook 210 from moving away from the clothes hanger slot, additionally.

Eventually, if the user positions the hook 210 in the clothes hanger slot for hanging the clothes hanger from the hanger bar, the holding rib 935*a* of the holding rubber piece will make elastic holding of an outside surface of the hook, and the moving away preventive rib 935*c* prevents the hook 210 from moving away from the clothes hanger slot during the translational motion of the hanger bar.

It will be apparent to those skilled in the art that various modifications and variations can be made in the present invention without departing from the spirit or scope of the invention. Thus, is intended that the present invention cover the modifications and variations of this invention provided they come within the scope of the appended claims and their equivalents.

Therefore, the present invention has following advantageous effects.

The present invention provides a laundry treating apparatus which can make easy drying, deodorizing, crumple removal, and sterilization of clothes.

And, the present invention can provide a laundry treating apparatus which can house different types of clothes hangers.

What is claimed is:

1. A laundry treating apparatus comprising:

a clothes housing portion for accommodating clothes therein;

a supply unit for supplying air or moisture to the clothes housing portion;

a clothes hanger provided to hang clothes and to have a hook for placing the clothes hung therefrom in the clothes housing portion or taking the clothes hung therefrom away from the clothes housing portion;

a hanger bar positioned in the clothes housing portion, the hanger bar having clothes hanger slots each for receiving the hook;

a driving unit for making the hanger bar to move in the clothes housing portion; and a hook holding portion provided to each of the clothes hanger slots for holding of the hook of the clothes hanger elastically, wherein the hook holding portion is provided as one pair at opposite ends of the clothes hanger slot respectively, and the one pair of the hook holding portions include:

fixed portions fixed to opposite ends of the clothes hanger slot respectively; and extensions extended from the fixed portions, respectively.

2. The laundry treating apparatus as claimed in claim 1, wherein the extension formed each of the one pair of the hook holding portions has an elastic force applied thereto in directions opposite to each other.

3. The laundry treating apparatus as claimed in claim 2, wherein the extension formed each of the one pair of the hook holding portions is in contact with each other.

4. A laundry treating apparatus comprising:

a clothes housing portion for accommodating clothes therein;

a supply unit for supplying air or moisture to the clothes housing portion;

a clothes hanger provided to hang clothes and to have a hook for placing the clothes hung therefrom in the clothes housing portion or taking the clothes hung therefrom away from the clothes housing portion;

a hanger bar positioned in the clothes housing portion, the hanger bar having clothes hanger slots each for receiving the hook;

a driving unit for making the hanger bar to move in the clothes housing portion; and a hook holding portion provided to each of the clothes hanger slots for holding of the hook of the clothes hanger elastically, wherein the hook holding portion includes;

a holding portion provided in the clothes hanger slot so as to be in contact with the hook, and an elastic member for making elastic supporting of the holding portion to enable the holding portion to move within the clothes hanger slot, wherein the holding portion is provided to opposite ends of the clothes hanger slot for holding opposite sides of the hook.

5. The laundry treating apparatus as claimed in claim 4, wherein the holding portion has a sloped top side.

6. A laundry treating apparatus comprising:

a clothes housing portion for accommodating clothes therein;

a supply unit for supplying air or moisture to the clothes housing portion;

a clothes hanger provided to hang clothes and to have a hook for placing the clothes hung therefrom in the clothes housing portion or taking the clothes hung therefrom away from the clothes housing portion;

a hanger bar positioned in the clothes housing portion, the hanger bar having clothes hanger slots each for receiving the hook;

a driving unit for making the hanger bar to move in the clothes housing portion; and a hook holding portion provided to each of the clothes hanger slots for holding of the hook of the clothes hanger elastically, wherein the hook holding portion is a holding rubber piece, wherein the holding rubber piece includes;

a holding surface provided in the clothes hanger slot so as to be in contact with the hook, and a coupling surface which is extended from the holding surface and fixed to the clothes hanger slot.

7. The laundry treating apparatus as claimed in claim 6, wherein the holding rubber piece is provided to the opposite ends of the clothes hanger slot.

8. The laundry treating apparatus as claimed in claim 7, wherein the holding surface has a sloped top side.

9. A laundry treating apparatus comprising:

a clothes housing portion for accommodating clothes therein;

a supply unit for supplying air or moisture to the clothes housing portion;

a clothes hanger provided to hang clothes and to have a hook for placing the clothes hung therefrom in the clothes housing portion or taking the clothes hung therefrom away from the clothes housing portion;

a hanger bar positioned in the clothes housing portion, the hanger bar having clothes hanger slots each for receiving the hook;

a driving unit for making the hanger bar to move in the clothes housing portion; and a hook holding portion provided to each of the clothes hanger slots for holding of the hook of the clothes hanger elastically, wherein the hook holding portion includes a holding rib which is an extension from one end of the clothes hanger slot so as to be in contact with the hook, and the holding rib is formed of rubber.

10. The laundry treating apparatus as claimed in claim 9, wherein the hook holding portion includes a moving away preventive rib having a length greater than a length of the holding rib for preventing the hook from moving away from the clothes hanger slot.

11. A laundry treating apparatus comprising:

a clothes housing portion for housing clothes therein;

a supply unit for supplying air or moisture to the clothes housing portion;

a clothes hanger provided to hang the clothes and to have a hook for placing the clothes hung therefrom in the clothes housing portion or taking the clothes hung therefrom away from the clothes housing portion;

a hanger bar positioned in the clothes housing portion, the hanger bar having clothes hanger slots each for receiving the hook;

a driving unit for making the hanger bar to move in the clothes housing portion; and a hook holding portion provided to each of the clothes hanger slots for providing a space for receiving the hook according to a diameter of the hook, wherein the hook holding portion is provided as one pair at opposite ends of the clothes hanger slot respectively, and the one pair of the hook holding portions include:

fixed portions fixed to opposite ends of the clothes hanger slot respectively; and extensions extended from the fixed portions, respectively.

12. A laundry treating apparatus comprising:

a clothes housing portion for accommodating clothes therein;

a supply unit for supplying air or moisture to the clothes housing portion;

a hanger bar positioned in the clothes housing portion, the hanger bar having clothes hanger slots for receiving a hook of a clothes hanger provided to hang clothes;

a driving unit for making the hanger bar to move in the clothes housing portion; and a hook holding portion provided to each of the clothes hanger slots for holding of the hook of the clothes hanger elastically, wherein the hook holding portion is provided as one pair at opposite ends of the clothes hanger slot respectively, and the one pair of the hook holding portions include:

fixed portions fixed to opposite ends of the clothes hanger slot respectively; and extensions extended from the fixed portions, respectively.

* * * * *